US008378914B2

(12) United States Patent
Lee et al.

(10) Patent No.: US 8,378,914 B2
(45) Date of Patent: Feb. 19, 2013

(54) DIPOLE ANTENNA

(75) Inventors: Chang-Jung Lee, Taoyuan County (TW); Jian-Jhih Du, Taipei (TW)

(73) Assignee: Arcadyan Technology Corporation, Hsinchu (TW)

( * ) Notice: Subject to any disclaimer, the term of this patent is extended or adjusted under 35 U.S.C. 154(b) by 277 days.

(21) Appl. No.: 12/647,288

(22) Filed: Dec. 24, 2009

(65) Prior Publication Data

US 2010/0164825 A1 Jul. 1, 2010

(30) Foreign Application Priority Data

Dec. 25, 2008 (TW) ..... 97150710 A

(51) Int. Cl.
*H01Q 9/16* (2006.01)

(52) U.S. Cl. ..... 343/795; 343/807; 343/822

(58) Field of Classification Search ..... 343/700 MS, 343/793, 795, 807, 822, 846
See application file for complete search history.

(56) References Cited

U.S. PATENT DOCUMENTS

| | | | | |
|---|---|---|---|---|
| 5,867,130 | A * | 2/1999 | Tay et al. | 343/795 |
| 7,839,336 | B2 * | 11/2010 | Koshiji et al. | 343/700 MS |
| 2008/0180342 | A1 * | 7/2008 | Kerselaers | 343/795 |

FOREIGN PATENT DOCUMENTS

| | | | |
|---|---|---|---|
| CN | 101167214 | A | 4/2008 |
| GB | 2347792 | A | 9/2000 |

* cited by examiner

*Primary Examiner* — Robert Karacsony
(74) *Attorney, Agent, or Firm* — Muncy, Geissler, Olds & Lowe, PLLC

(57) ABSTRACT

A dipole antenna includes a first radiating body and a second radiating body. The first radiating body has a first radiating part and a second radiating part. The area of the second radiating part is larger than that of the first radiating part. The second radiating body is disposed opposite to the first radiating body and has a third radiating part and a fourth radiating part. The area of the third radiating part is larger than that of the first radiating part. The area of the second radiating part is larger than that of the fourth radiating part. The first radiating part or the third radiating part has a feeding point. The second radiating part or the fourth radiating part has a ground point. The first radiating part is electrically connected to the third radiating part. The second radiating part is electrically connected to the fourth radiating part.

18 Claims, 7 Drawing Sheets

DIPOLE ANTENNA

CROSS REFERENCE TO RELATED APPLICATIONS

This Non-provisional application claims priority under 35 U.S.C. §119(a) on Patent Application No(s). 097150710 filed in Taiwan, Republic of China on Dec. 25, 2008, the entire contents of which are hereby incorporated by reference.

BACKGROUND OF THE INVENTION

1. Field of Invention

The present invention relates to an antenna and, in particular, to a dipole antenna.

2. Related Art

The vigorous development of wireless transmission brings various products and technologies applying multi-frequency band transmission, such that many new products have the wireless transmission functions for satisfying customers' demands. The products with multi-frequency functions need to process various signals from the peripheral wireless device, for example, Bluetooth, WiFi, or GPS. With additional functions of WLAN and WiMAX, the signal process is becoming more complex for the products since they need the antenna to receive and transmit the wireless signals that operate at different frequency bands and thus, the antenna that can receive multi-frequency band signal is needed.

The suitable antenna not only matches the appearance of the product and enhances the transmission property, but also further reduces the product cost. The antennas currently used in different products are manufactured in different ways and with different materials.

Conventional dipole antennas usually operate in the band coverage approximately between 2.3 GHz and 2.6 GHz. However, this is not enough for the current wireless communication.

In addition, with reference to FIG. 1, the conventional dipole antenna 1 is to dispose a triangular first radiating part 121 and a triangular second radiating part 122 on a surface of a substrate 11 and to generate the frequency resonance by feeding the signal from a feeding point 13 and a ground point 14, so the antenna can operate. However, this dipole antenna 1 has a smaller operating band coverage that cannot meet the requirement of multi-frequency band on market.

As mentioned above, it is apparent that the conventional dipole antenna does not have sufficient band coverage. Therefore, it is an important subject of the present invention to manufacture a dipole antenna that has a small size and can operate in multi-frequency band.

SUMMARY OF THE INVENTION

In view of the foregoing, the present invention is to provide a dipole antenna that has a small size and is able to operate in dual band or multi-frequency band.

To achieve the above, the dipole antenna according to the present invention includes a first radiating body and a second radiating body. The first radiating body has a first radiating part and a second radiating part, and the area of the second radiating part is larger than that of the first radiating part. The second radiating body is disposed opposite to the first radiating body and includes a third radiating part and a fourth radiating part. The area of the third radiating part is larger than that of the first radiating part and the area of the second radiating part is larger than that of the fourth radiating part. The first radiating part is electrically connected to the third radiating part, and the first radiating part or the third radiating part has at least one feeding point. The second radiating part is electrically connected to the fourth radiating part, and the second radiating part or the fourth radiating part has at least one ground point.

As mentioned above, the dipole antenna according to the present invention is to dispose the asymmetrical first radiating body and second radiating body opposite to each other, and the first radiating body includes the asymmetrical first radiating part and second radiating part. The first radiating part has a first top side, the second radiating part has a second top side, and the first top side is disposed adjacent to the second top side. The second radiating body includes the asymmetrical third radiating part and fourth radiating part. The third radiating part has a third top side, the fourth radiating part has a fourth top side, and the third top side is disposed adjacent to the fourth top side such that the second radiating body may operate in dual band. Furthermore, by adjusting the size of the antenna, the band coverage of the dipole antenna may be increased.

As described above, the dipole antenna according to the present invention includes the asymmetrical first radiating body and second radiating body. The first radiating part is spread from the first top side to the first bottom side with a first angle. The second radiating part is spread from the second top side to the second bottom side with a second angle. The third radiating part is spread from the third top side to the third bottom side with a third angle. The fourth radiating part is spread from the fourth top side to the fourth bottom side with a fourth angle. By varying the first angle, the second angle, the third angle, and the fourth angle, the operating frequency of the dipole antenna may be adjusted.

As mentioned above, the dipole antenna according to the present invention includes the asymmetrical first radiating body and second radiating body. The direction from the first top side of the first radiating part to the first bottom side of the first radiating part is opposite to the direction from the second top side of the adjacent second radiating part to the second bottom side of the second radiating part, and the distances from the first top side to the first bottom side and from the second top side to the second bottom side are a first length and a second length, respectively. The direction from the third top side of the third radiating part to the third bottom side of the third radiating part is opposite to the direction from the fourth top side of the adjacent fourth radiating part to the fourth bottom side of the fourth radiating part, and the distances from the third top side to the third bottom side and from the fourth top side to the fourth bottom side are a third length and a fourth length, respectively. By varying the first length, the second length, the third length, and the fourth length, the operating frequency of the dipole antenna may be adjusted.

As described above, the dipole antenna according to the present invention includes the asymmetrical first radiating body and second radiating body. The shapes and sizes of the first radiating part and the fourth radiating part are the same, which means, the first angle is equal to the fourth angle and the first length is equal to the fourth length. The shapes and sizes of the second radiating part and the third radiating part are the same, which means, the second angle is equal to the third angle and the second length is equal to the third length.

As mentioned above, the dipole antenna according to the present invention includes the asymmetrical first radiating body and second radiating body. The first radiating part and the fourth radiating part operate at a first frequency, and the second radiating part and the third radiating part operate at a second frequency. The first frequency is higher than the second frequency.

As described above, the dipole antenna according to the present invention further includes an impedance matching part that is disposed adjacent to the first radiating body or the second radiating body. There is a gap between the impedance matching part and the first radiating body or the second radiating body, which means, the impedance matching part does not overlap the projection of the first radiating body or the projection of the second radiating body. By adjusting the size of the impedance matching part, the operating bandwidth of the dipole antenna can be increased and hence improve the impedance matching of the dipole antenna.

As mentioned above, the dipole antenna according to the present invention further includes a dielectric layer that is disposed between the corresponding first radiating body and second radiating body. The first radiating body is disposed on one side of the dielectric layer and the second radiating body is disposed on another side of the dielectric layer. The gap between the first radiating body and the second radiating may be adjusted by selecting different thicknesses of the dielectric layers so the dipole antenna may operate in different frequency bands.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
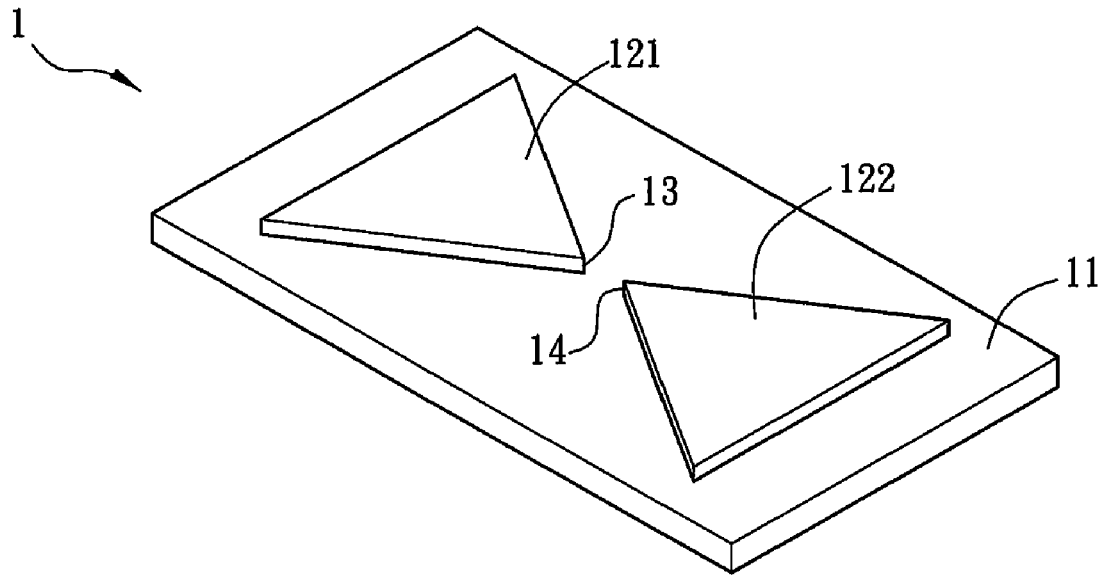
FIG. 1 (Prior Art)
FIG. 1 is a schematic view of a conventional dipole antenna.
Figure 2:
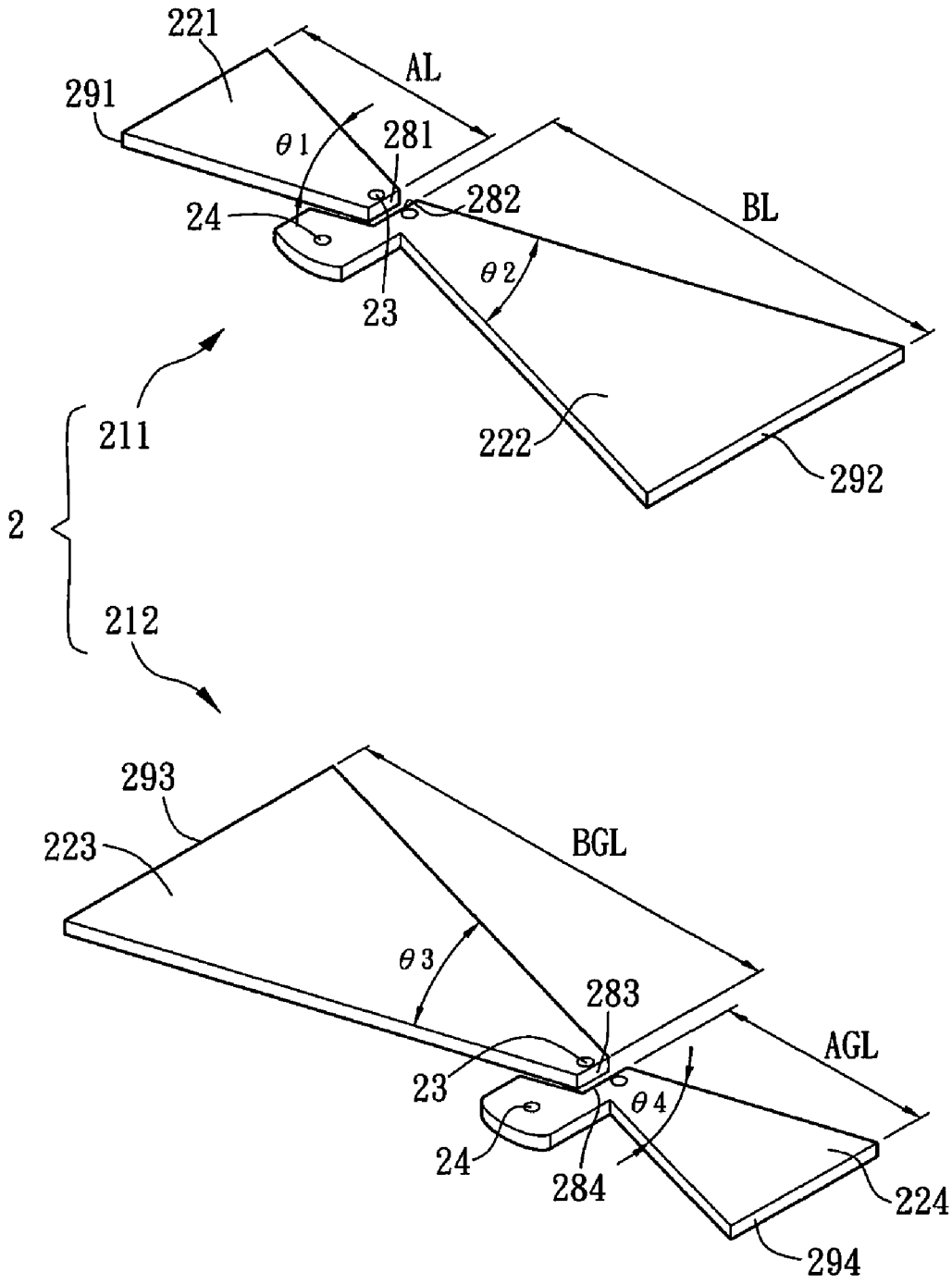
FIG. 2 is a schematic view of a dipole antenna according to a preferred embodiment of the present invention.

FIG. 2 is a schematic view of a dipole antenna according to a preferred embodiment of the present invention. With reference to FIG. 2, the dipole antenna 2 includes a first radiating body 211 and a second radiating body 212.

The first radiating body 211 includes a first radiating part 221 and a second radiating part 222. The first radiating part 221 and the second radiating part 222 are asymmetrical, and the area of the second radiating part 222 is larger than that of the first radiating part 221.

The second radiating body 212 is disposed opposite to the first radiating body 211 and has a third radiating part 223 and a fourth radiating part 224. The third radiating part 223 and the fourth radiating part 224 are asymmetrical, and the area of the third radiating part 223 is larger than that of the fourth radiating part 224.

The first radiating part 221 and the second radiating part 222 may be triangular or trapezoid, respectively. The first radiating part 221 has a first top side 281 and the second radiating part 222 has a second top side 282. The first top side 281 is disposed adjacent to the second top side 282. The third radiating part 223 and the fourth radiating part 224 may be triangular or trapezoid, respectively. The third radiating part has a third top side 283 and the fourth radiating part has a fourth top side 284. The third top side 283 is disposed adjacent to the fourth top side 284. The area of the third radiating part 223 is larger than that of the first radiating part 221, and the area of the second radiating part 222 is larger than that of the fourth radiating part 224. The first radiating part 221 is electrically connected to the third radiating part 223, and one of the first radiating part 221 and the third radiating part 223 has a feeding point 23. The second radiating part 222 is electrically connected to the fourth radiating part 224, and one of the second radiating part 222 and the fourth radiating part 224 has a ground point. In the embodiment, the second radiating part 222 has the ground point 24 for example.

The direction from the first top side 281 of the first radiating part 221 to a corresponding first bottom side 291 of the first radiating part 221 is opposite to the direction from the second top side 282 of the adjacent second radiating part 222 to a corresponding second bottom side 292 of the second radiating part 222. The distances from the first top side 281 to the first bottom side 291 and from the second top side 282 to the second bottom side 292 are a first length AL and a second length BL, respectively. The direction from the third top side 283 of the third radiating part 223 to a corresponding third bottom side 293 of the third radiating part 223 is opposite to the direction from the fourth top side 284 of the adjacent fourth radiating part 224 to a corresponding fourth bottom side 294 of the fourth radiating part 224. The distances from the third top side 283 to the third bottom side 293 and from the fourth top side 284 to the fourth bottom side 294 are a third length BGL and a fourth length AGL, respectively. In the embodiment, the first length AL is equal to the fourth length AGL and the second length BL is equal to the third length BGL.

The first radiating part 221 is spread from the first top side 281 to the first bottom side 291 with a first angle θ1. The second radiating part 222 is spread from the second top side 282 to the second bottom side 292 with a second angle θ2. The third radiating part 223 is spread from the third top side 283 to the third bottom side 293 with a third angle θ3. The fourth radiating part 224 is spread from the fourth top side 284 to the fourth bottom side 294 with a fourth angle θ4. In the embodiment, the first angle θ1 and the fourth angle θ4 are the same, and the second angle θ2 and the third angle θ3 are the same.

The first angle θ1, the second angle θ2, the third angle θ3, and the fourth angle θ4 are between 30 degrees to 120 degrees, respectively.

The first radiating part 221 and the fourth radiating part 224 operate at a first frequency, and the second radiating part 222 and the third radiating part 223 operate at a second frequency. The first frequency is higher than the second frequency.

The dipole antenna according to the preferred embodiment of the present invention is further illustrated with two examples as follows.

FIRST EXAMPLE

Figure 3A:
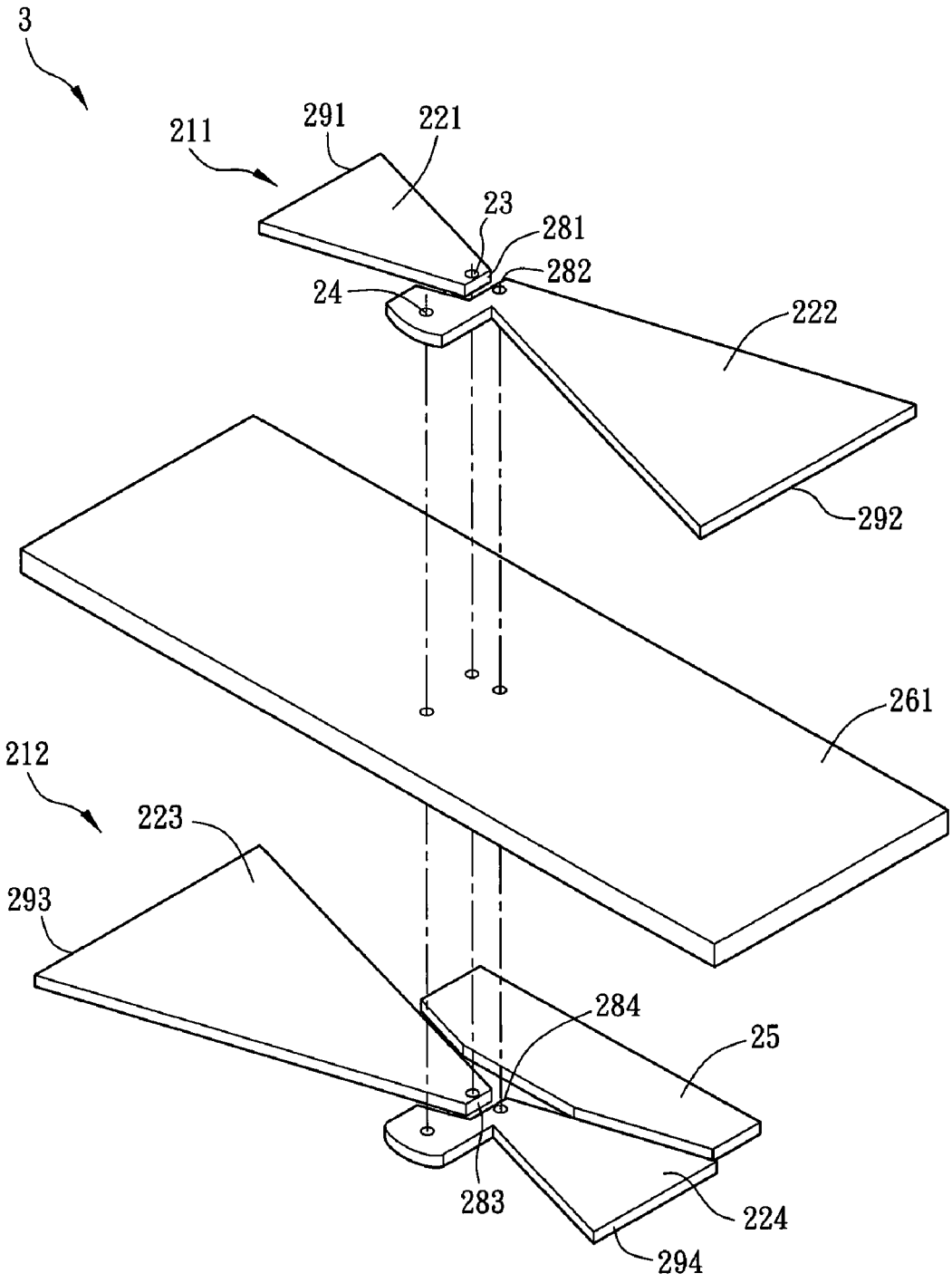
FIG. 3A is an exploded view of a dipole antenna according to a first example of the preferred embodiment of the present invention.

FIG. 3A is an exploded view of a dipole antenna 3 according to the first example. With reference to FIG. 3A, the dipole antenna 3 includes a first dielectric layer 261, a first radiating body 211, a second radiating body 212 and an impedance matching part 25.

The first radiating body 211 is disposed on one side of the first dielectric layer 261, and the second radiating body 212 is disposed on the other side of the first dielectric layer 261. The impedance matching part 25 is polygonal. In the embodiment, the impedance matching part 25 is disposed adjacent to the second radiating body 212, and there is a gap between the impedance matching part 25 and the second radiating body 212. In addition, the impedance matching part 25 may also be disposed adjacent to the first radiating body 211. The disposition of the impedance matching part 25 is not limited to these; however, the impedance matching part 25 must not overlap the vertical projections of the first radiating body 211 and the second radiating body 212, and there must be a gap between the impedance matching part 25 and the first radiating body 211, and a gap must exist between the impedance matching part 25 and the first and second radiating bodies 211 and 212.

Figure 3B:
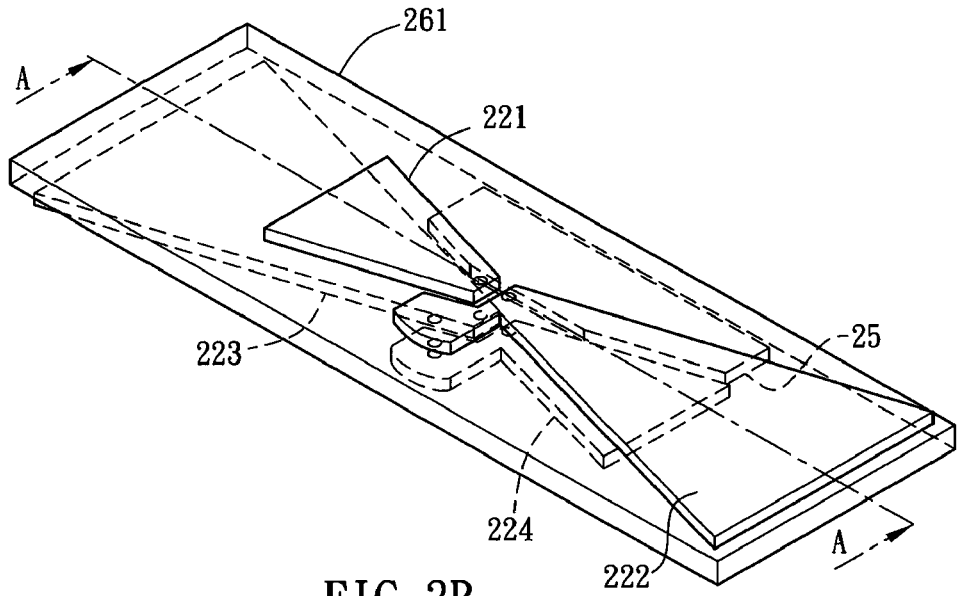
FIG. 3B is a schematic view of the dipole antenna according to the first example of the preferred embodiment of the present invention.
Figure 3C:
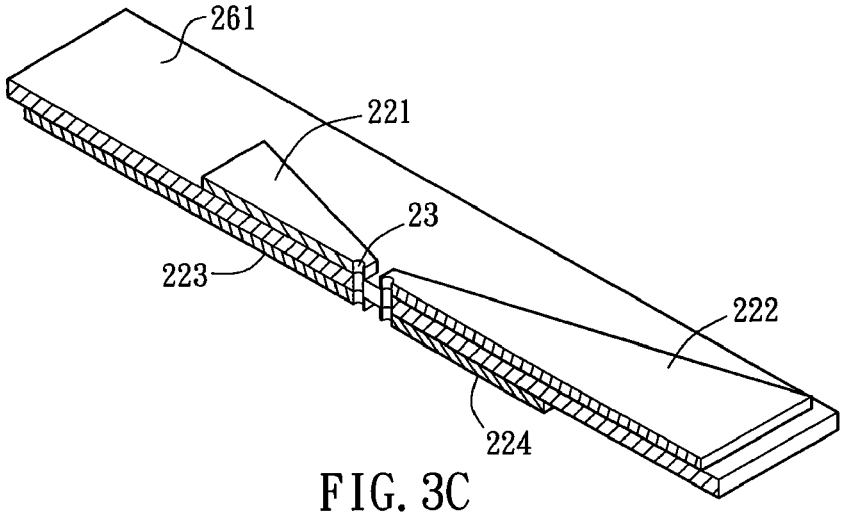
FIG. 3C is a cross-sectional view of the dipole antenna according to the first example of the preferred embodiment of the present invention.

FIG. 3B is a schematic view of the first dielectric layer 261 with the first radiating body 211 according to the first example of the present invention. With reference to FIG. 3B, the first radiating body 211, the first dielectric layer 261 and the second radiating body 212 are assembled together. FIG. 3C is a cross-sectional view along a line A-A in FIG. 3B. With reference to FIG. 3C, the first radiating part 211 is electrically connected to the third radiating part 223 via holes, and the second radiating part 222 is electrically connected to the fourth radiating part 224 via holes.

Figure 3D:
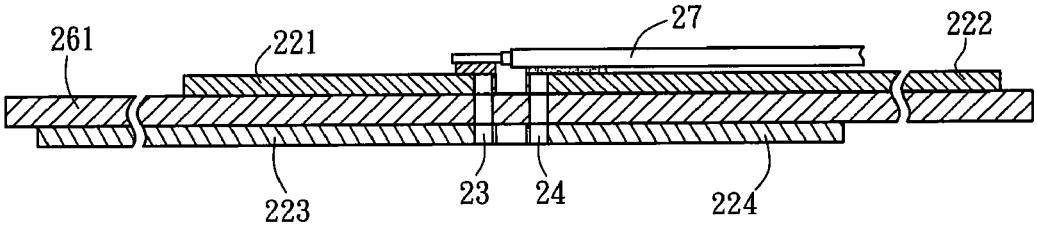
FIG. 3D is another schematic view of the dipole antenna according to the first example of the preferred embodiment of the present invention.

FIG. 3D is another schematic view of the dipole antenna according to the first example. With reference to FIG. 3D, a conductive element 27 is used to electrically connect the feeding point 23 of the first radiating part 221 and the ground point 24 of the second radiating part 222 for feeding the signal to the dipole antenna 3. The conductive element 27 may be a microstrip or a coaxial transmission line.

SECOND EXAMPLE

Figure 4:
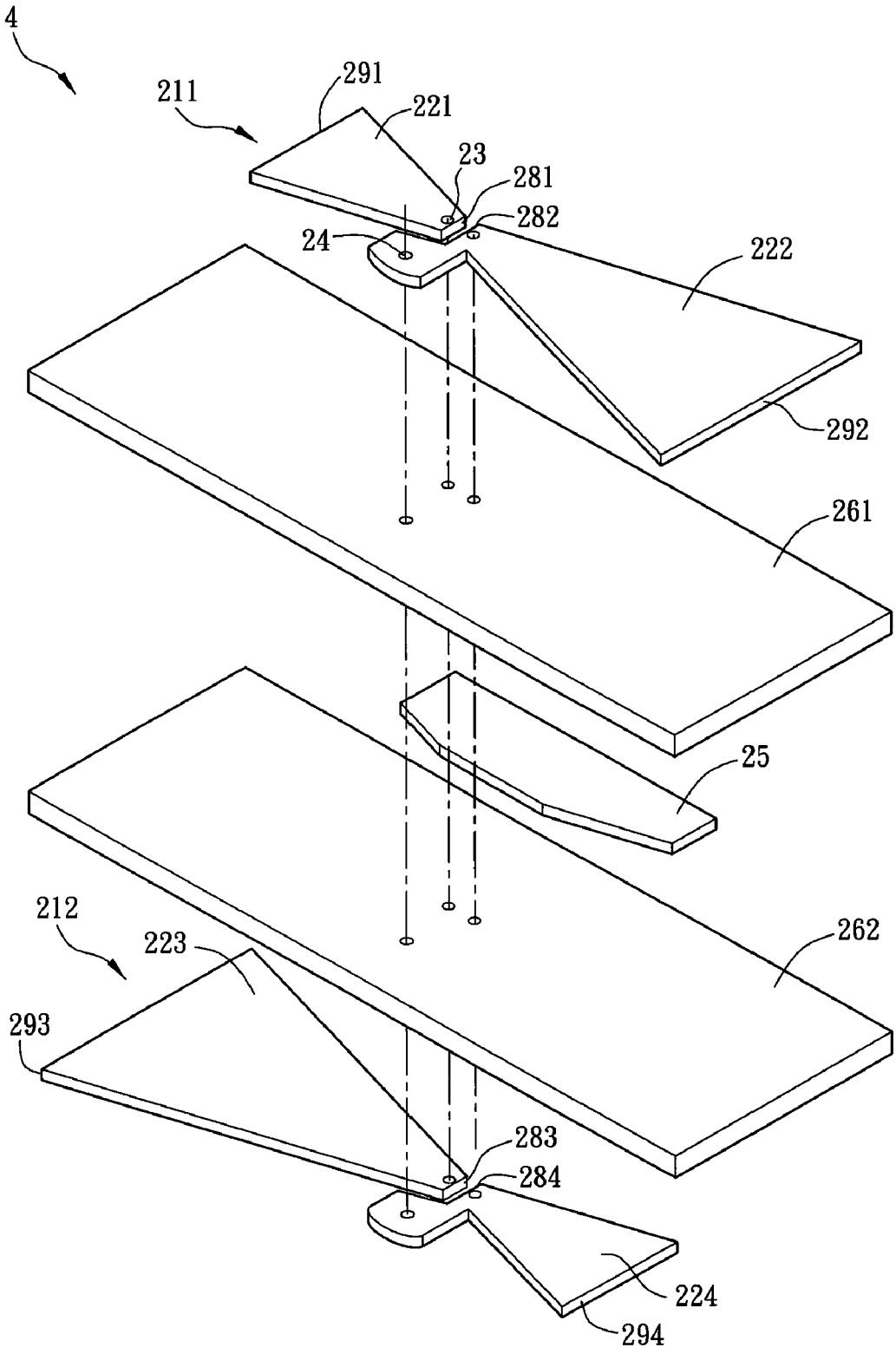
FIG. 4 is a schematic view of a dipole antenna according to a second example of the preferred embodiment of the present invention.

FIG. 4 is a schematic view of a dipole antenna 4 according to the second example. The dipole antenna 4 includes a first dielectric layer 261, a second dielectric layer 262, a first radiating body 211, a second radiating body 212 and an impedance matching part 25.

The impedance matching part 25 is polygonal and disposed between a first dielectric layer 261 and a second dielectric layer 262. The first radiating body 211 is disposed on one side of the first dielectric layer 261 away from the impedance matching part 25 and the second radiating body 212 is disposed on the other side of the second dielectric layer 262 In the example, the first radiating body 211, the second radiating body 212 and the impedance matching part 25 are disposed on different layers, respectively, and the impedance matching part 25 may be disposed at any position but must not overlap the vertical projections of the first radiating body 211 and the second radiating body 212.

Figure 5A:
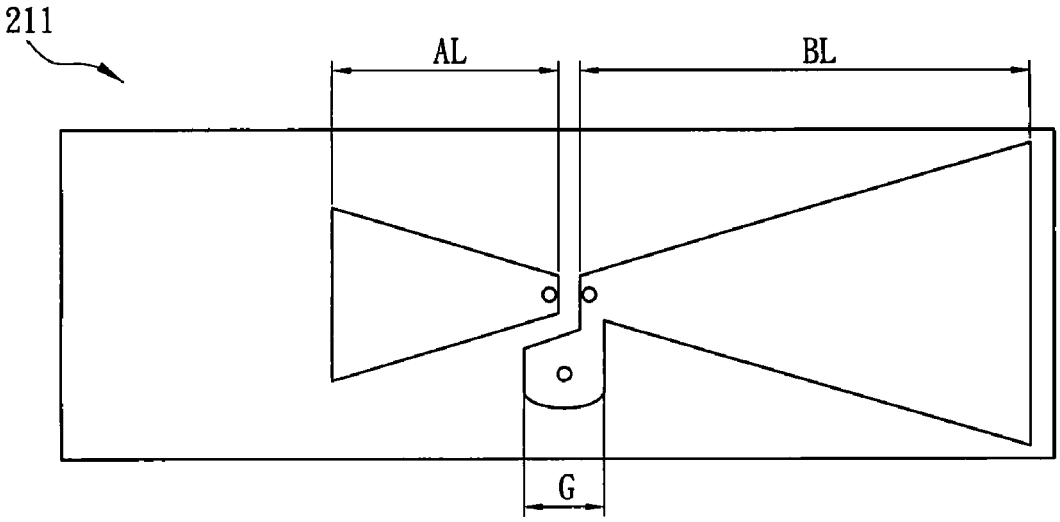
FIG. 5A is a schematic view of a first radiating body of the dipole antenna according to the preferred embodiment of the present invention.
Figure 5B:
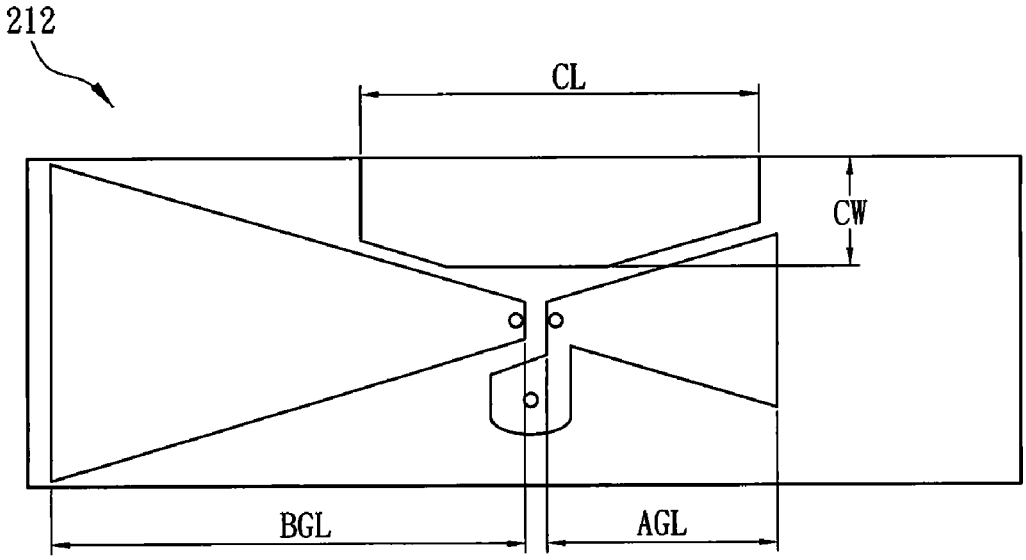
FIG. 5B is a schematic view of a second radiating body of the dipole antenna according to the preferred embodiment of the present invention.

With reference to FIGS. 5A and 5B, the first length AL of the first radiating part 221, the second length BL of the second radiating part 222, the third length BGL of the third radiating part 223, and the fourth length AGL of the fourth radiating part 224 are adjusted to reach the required frequency bands in accordance with the desired operating frequency bands of the dipole antenna. The resonant bandwidth may also be increased by adjusting the length CL and the width CW of the impedance matching part 25.

For example, as the dipole antenna is used at the dual-band frequency between 2.3 GHz and 2.76 GHz, the sizes of the radiating parts may be BGL1 0.1λ~0.2λ, BL≈0.1λ~0.2λ, CL≈0.09λ~0.19λ, CW≈0.015λ~0.045λ, and G≈0.01λ~0.04λ. As the dipole antenna is used at the dual-band frequency between 3.3 GHz and 3.8 GHz, the sizes of the radiating parts may be AL=AGL≈0.05λ~0.2λ, CL≈0.05λ~0.3λ, CW≈0.02λ~0.15λ, and G≈0.015λ~0.1λ.

Another example is further illustrated as follows. As the dipole antenna is used at the dual-band frequency between 2.3 GHz and 2.76 GHz, the sizes of these elements may be BGL BL≈0.1λ~0.2~, CL≈0.09λ~0.19λ, CW≈0.015λ~0.045λ, and G≈0.01λ~0.04λ. As the dipole antenna is used at the dual-band frequency between 3.3 GHz and 3.8 GHz, the sizes of these elements may be AL=AGL≈0.04λ~0.2λ, CL≈0.05λ~0.3λ, CW≈0.02λ~0.15λ, and G≈0.015λ~0.1λ. As the dipole antenna is used at the dual-band frequency between 4.9 GHz and 6 GHz, the sizes of these elements may be AL=AGL≈0.05λ~0.2λ, CL≈0.2λ~0.5π, CW≈0.02λ~0.15λ, and G≈0.03λ~0.2λ.

Regarding to the above-mentioned dipole antenna, the larger the width of the radiating part for triggering the travelling wave, the easier the antenna to be operated in low frequency band; and the smaller the width of the radiating part for triggering the travelling wave, the easier the antenna to be operated in high frequency band. However, the increase in width of the radiating part adds up the size of the dipole antenna. In the present invention, the size of the impedance matching part 25 can be adjusted for impedance matching, such that the antenna may operate in high frequency band and low frequency band simultaneously.

Figure 6:
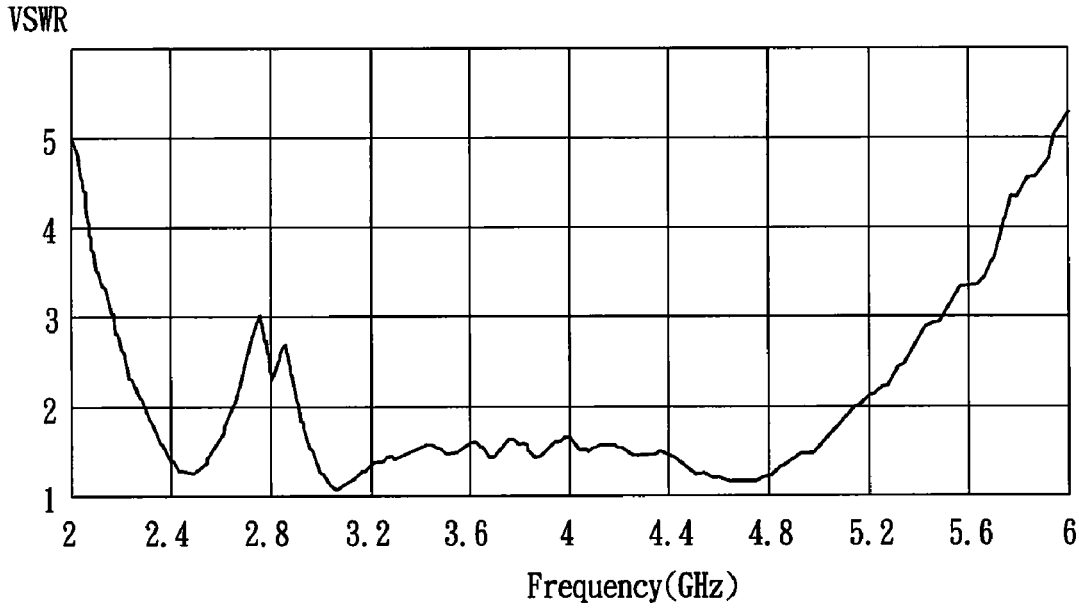
FIG. 6 is a voltage standing wave ratio (VSWR) graph of the dipole antenna according to the preferred embodiment of the present invention.
Figure 7:
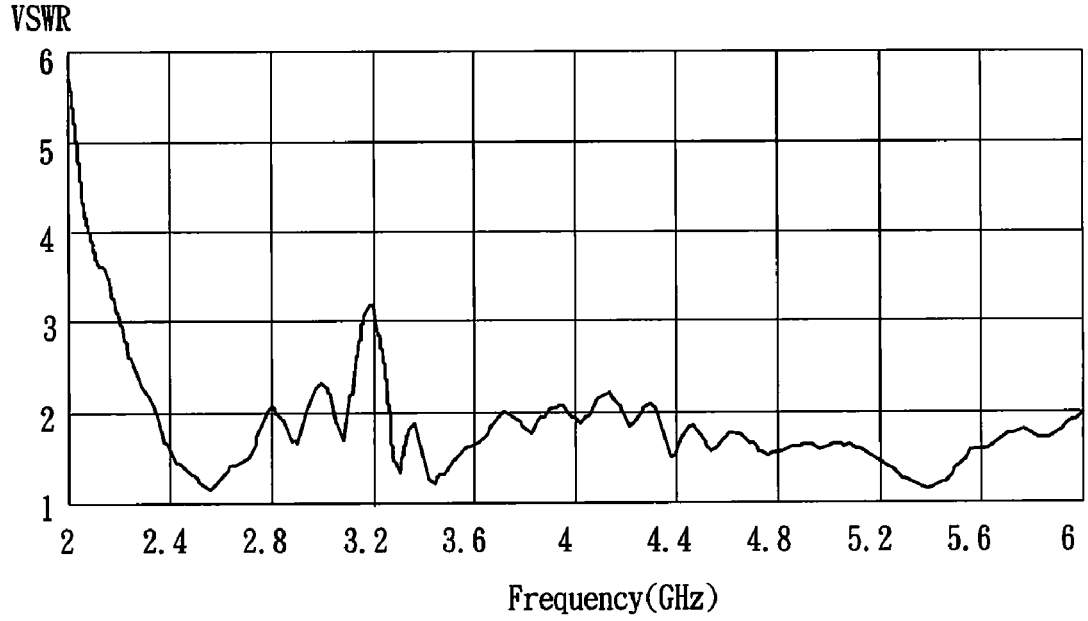
FIG. 7 is another VSWR graph of the dipole antenna according to the preferred embodiment of the present invention.

FIG. 6 is a graph of the voltage standing wave ratio (VSWR) measurement of the dipole antenna at the multi-frequency band according to the embodiment. FIG. 7 is a graph of the VSWR measurement of the dipole antenna at the multi-frequency band according to the embodiment. In FIGS. 6 and 7, the vertical axis represents VSWR and the horizontal axis represents frequency. The commonly accepted VSWR is approximately 2. Accordingly, as in dual-band, the dipole antenna of the above embodiment will operate between 2.3 GHz~2.7 GHz and between 3.3 GHz~3.8 GHz, and as in multi-frequency band, the dipole antenna will operate between 2.3 GHz~2.7 GHz, between 3.3 GHz~3.8 GHz, and between 4.9 GHz~6 GHz.

To sum up, the dipole antenna according to the present invention is to dispose the asymmetrical first radiating body and second radiating body opposite to each other. The first radiating body includes the asymmetrical first radiating part and second radiating part, and the second radiating body includes the asymmetrical third radiating part and fourth radiating part, such that the first radiating body and the second radiating body may operate in dual-band. Moreover, the impedance matching part is used for impedance matching so as to increase the operating frequency bands. Therefore, the dipole antenna is able to operate in multi-frequency bands. The band coverage of the dipole antenna may also be adjusted and the size of the dipole antenna may be effectively reduced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A dipole antenna, comprising: a first radiating body comprising a first radiating part and a second radiating part, the first radiating part having a first top side, and the second radiating part having a second top side, wherein the first top side is disposed adjacent to the second top side and the area of the second radiating part is larger than that of the first radiating part;

a second radiating body disposed opposite to the first radiating body and comprising a third radiating part and a fourth radiating part, the third radiating part having a third top side, and the fourth radiating part having a fourth top side, wherein the third top side is disposed adjacent to the fourth top side, the area of the third radiating part is larger than that of the first radiating part, the area of the second radiating part is larger than that of the fourth radiating part, the first radiating part is electrically connected to the third radiating part and has at least one feeding point, and the second radiating part is electrically connected to the fourth radiating part and has at least one ground point: and a first dielectric layer, wherein the first radiating part and the second radiating part are disposed on a side of the first dielectric layer and the third radiating part and the fourth radiating part are disposed on another side of the first dielectric layer.

2. The dipole antenna according to claim 1, wherein the first radiating part or the second radiating is triangular or trapezoid.

3. The dipole antenna according to claim 1, wherein the direction from the first top side of the first radiating part to a corresponding first bottom side of the first radiating part is opposite to the direction from the second top side of the adjacent second radiating part to a corresponding second bottom side of the second radiating part, and the distances from the first top side to the first bottom side and from the second top side to the second bottom side are a first length and a second length, respectively.

4. The dipole antenna according to claim 3, wherein the first radiating part is spread from the first top side to the first bottom side with a first angle, the second radiating part is spread from the second top side to the second bottom side with a second angle, the third radiating part is spread from the third top side to a third bottom side with a third angle, and the fourth radiating part is spread from the fourth top side to a fourth bottom side with a fourth angle.

5. The dipole antenna according to claim 4, wherein the first angle, the second angle, the third angle, and the fourth angle are between 30 degrees to 120 degrees.

6. The dipole antenna according to claim 1, wherein the third radiating part or the fourth radiating part is triangular or trapezoid.

7. The dipole antenna according to claim 1, wherein the direction from the third top side of the third radiating part to a corresponding third bottom side of the third radiating part is opposite to the direction from the fourth top side of the adjacent fourth radiating part to a corresponding fourth bottom side of the fourth radiating part, and the distances from the third top side to the third bottom side and from the fourth top side to the fourth bottom side are a third length and a fourth length, respectively.

8. The dipole antenna according to claim 7, wherein the first radiating part is spread from the first top side to a first bottom side with a first angle, the second radiating part is spread from the second top side to a second bottom side with a second angle, the third radiating part is spread from the third top side to the third bottom side with a third angle, and the fourth radiating part is spread from the fourth top side to the fourth bottom side with a fourth angle.

9. The dipole antenna according to claim 8, wherein the first angle, the second angle, the third angle, and the fourth angle are between 30 degrees to 120 degrees.

10. The dipole antenna according to claim 1, wherein the first radiating part and the fourth radiating part operate at a first frequency, the second radiating part and the third radiating part operate at a second frequency, and the first frequency is higher than the second frequency.

11. The dipole antenna according to claim 1, further comprising:

an impedance matching part disposed adjacent to the first radiating body or the second radiating body, wherein a gap is disposed between the impedance matching part and the first radiating body or the second radiating body.

12. The dipole antenna according to claim 11, wherein the impedance matching part is polygonal.

13. The dipole antenna according to claim 1 operating at a frequency between 2.3 GHz and 2.7 GHz, between 3.3 GHz and 3.8 GHz, or between 4.9 GHz and 6 GHz.

14. The dipole antenna according to claim 1, further comprising:

a conductive element electrically connected to the feeding point and the ground point.

15. The dipole antenna according to claim 14, wherein the conductive element is a coaxial cable.

16. A dipole antenna, comprising:

a first radiating body comprising a first radiating part and a second radiating part, the first radiating part having a first top side, and the second radiating part having a second top side, wherein the first top side is disposed adjacent to the second top side and the area of the second radiating part is larger than that of the first radiating part;

a second radiating body disposed opposite to the first radiating body and comprising a third radiating part and a fourth radiating part, the third radiating part having a third top side, and the fourth radiating part having a fourth top side, wherein the third top side is disposed adjacent to the fourth top side, the area of the third radiating part is larger than that of the first radiating part, the area of the second radiating part is larger than that of the fourth radiating part, the first radiating part is electrically connected to the third radiating part and has at least one feeding point, and the second radiating part is electrically connected to the fourth radiating part and has at least one ground point;

a first dielectric layer, wherein the first radiating part and the second radiating part are disposed on the same surface of the first dielectric layer;

a second dielectric layer, wherein the third radiating part and the fourth radiating part are disposed on the same surface of the second dielectric layer; and an impedance matching part disposed between the first dielectric layer and the second dielectric layer.

17. The dipole antenna according to claim 16, wherein the impedance matching part is polygonal.

18. The dipole antenna according to claim 16, wherein the first radiating body is disposed on a side of the first dielectric layer away from the impedance matching part and the second radiating body is disposed on a side of the second dielectric layer away from the impedance matching part.

* * * * *